US005122109A

United States Patent [19]

Kubota et al.

[11] Patent Number: 5,122,109

[45] Date of Patent: Jun. 16, 1992

[54] FOLDING DRUM IN A FOLDING MACHINE FOR A ROTARY PRESS

[75] Inventors: Satoru Kubota; Hidefumi Hirahara, both of Mihara, Japan

[73] Assignee: Mitsubishi Jukogyo Kabushiki Kaisha, Tokyo, Japan

[21] Appl. No.: 638,531

[22] Filed: Jan. 8, 1991

[30] Foreign Application Priority Data

Jan. 8, 1990 [JP] Japan ..... 2-382

[51] Int. Cl.[5] ..... B41F 13/62; B65H 45/16

[52] U.S. Cl. ..... 493/427; 493/431; 493/471

[58] Field of Search ..... 493/426, 427, 428, 429, 493/430, 431, 432, 433, 434, 435, 471, 476

[56] References Cited

U.S. PATENT DOCUMENTS 4,437,855 3/1984 Bullen ..... 493/427

FOREIGN PATENT DOCUMENTS 3821442 1/1989 Fed. Rep. of Germany .

*Primary Examiner*—William E. Terrell

*Attorney, Agent, or Firm*—Wenderoth, Lind & Ponack

[57] ABSTRACT

In a known folding drum of a folding machine for use with a rotary press, a web to be cut on the folding drum is guided and held by a plurality of parallel bands aligned in the axial direction of the folding drum and spanning a gap of the folding drum. Tips of a folding blade project to the outside of the folding drum through the gaps between the respective bands. In the present invention, at least two bands are integrally connected by a respective band mount portion with a plurality of groups of such integrally connected bands being provided. Each band mount portion is mounted to the folding drum via respective adjusting devices such that the expansion of the bands of each group thereof in the circumferential direction of the folding drum can be adjusted. Preferably, each adjusting device includes an adjusting plate engaged with an adjusting rack to which the bands are mounted, and an adjusting shaft. The adjusting plate is mounted to the adjusting shaft at an eccentric position with respect to its engagement with the adjusting rack.

3 Claims, 3 Drawing Sheets

FOLDING DRUM IN A FOLDING MACHINE FOR A ROTARY PRESS

BACKGROUND OF THE INVENTION

1. Field of the Invention

The present invention relates to a folding drum in a folding machine for use with a rotary press, and more particularly to improvements in a folding drum in a folding machine for use with a rotary press of the type in which a web to be cut on the folding drum is guided and held by means of a plurality of parallel bands aligned in the axial direction of the folding drum over a gap of the folding drum and in which tip end portions of a folding blade are projected to the outside of the folding drum through the gaps between the adjacent bands.

2. Description of the Prior Art

One example of the folding drum in a folding machine for a rotary press of the above-mentioned type will be described with reference to FIGS. 3 and 4.

In these figures, reference numeral 1 designates a generally cylindrical folding drum body, numeral 2 designates a folding blade, numeral 3 designates a pair of folding rollers, numeral 4 designates a needle device, numerals 5 and 6 designate covers, numeral 7 designates a needle receiving rack made of rubber, numeral 8 designates a holder, numeral 9 designates bands, numeral 10 designates a fixed bracket, numeral 11 designates a slide bracket on the folding drum side which can be moved by means of a screw 13, numeral 12 designates a pin, and numerals 14, 15, 16, 17, 18 and 19 designate bolts. In this type of folding machine, a cut web is folded up by means of the folding blade 2 of the folding drum and the pair of folding rollers 3. Within the folding drum body 1 is formed a vacancy 1*c* for accommodating the folding drum. This vacancy 1*c* opens at the outer circumferential surface of the folding drum body 1, and this opening is referred to as a "folding drum gap" 1*b*. Over this folding drum gap 1*b* are disposed bands 9 as aligned at appropriate intervals in the axial direction of the folding drum body 1 in four or five parallel rows. Respective end portions in the circumferential direction of the folding drum body 1 are mounted to the folding drum body 1 via a fixed bracket 10, and the other end portions in the circumferential direction of the folding drum body 1 are connected to a slide bracket 11 (a bracket that is movable by means of a screw 13) via pins 12. The tip end portions of the folding blade 2 project to the outside of the folding drum through the gaps between these bands 9.

In the folding machine for use with a rotary press in the prior art shown in FIGS. 3 and 4 and described above, though a web to be cut on the folding drum body 1 is guided and held by means of a plurality of the bands 9 aligned in the axial direction of the folding drum body 1 and disposed so as to span the folding drum gap 1*b*, a folded binder would fluter due to airflows in the folding drum gap 1*b* and in the gaps between the bands 9. Hence, problems such as end folding were liable to occur, and these problems resulted in unacceptable folded binders.

SUMMARY OF THE INVENTION

It is therefore one object of the present invention to provide an improved folding drum in a folding machine for use with a rotary press which can produce folded binders of good quality, which can perform a high-speed printing operation, and which can shorten the overall printing time.

According to one feature of the present invention, in a folding drum of a folding machine for use with a rotary press of the type in which a web to be cut on the folding drum body is guided and held by means of a plurality of parallel bands aligned in the axial direction of the folding drum body over a gap in the circumferential outer surface of the folding drum body and in which tip end portions of a folding blade are projected to the outside of the folding drum through the gaps between the respective bands, the respective bands are divided into groups each consisting of at least two bands, band mount portions for each group are formed integrally with the bands, and the band mount portions are mounted to the folding drum body via adjusting devices associated with the respective groups so that the expansion of the bands in the circumferential direction of the drum can be adjusted. Preferably, the adjusting device consists of an adjusting plate engaged with an adjusting rack to which the bands are mounted, and an adjusting shaft, the adjusting plate being mounted to the adjusting shaft at an eccentric position.

Thus, in the folding drum of a folding machine for use with a rotary press according to the present invention, adjustment can be effected by the respective adjusting devices in such a manner that the expansion of the bands in the circumferential direction of the drum body may be equalized. Consequently, the gaps between the respective bands can be made narrow. Hence, upon folding a web, a waving of the web at the folding drum gap is eliminated, it becomes possible to fold the web smoothly, and folded binders of good quality can be produced. This operation is especially effective in the case where the rotational speed of the folding drum is high. Thus, a high-speed printing operation becomes possible, and the overall printing time can be shortened.

The above-mentioned and other objects, features and advantages of the present invention will become more apparent by referring to the following description of one preferred embodiment of the invention taken in conjunction with the accompanying drawings.

DETAILED DESCRIPTION OF THE PREFERRED EMBODIMENT

Figure 1:
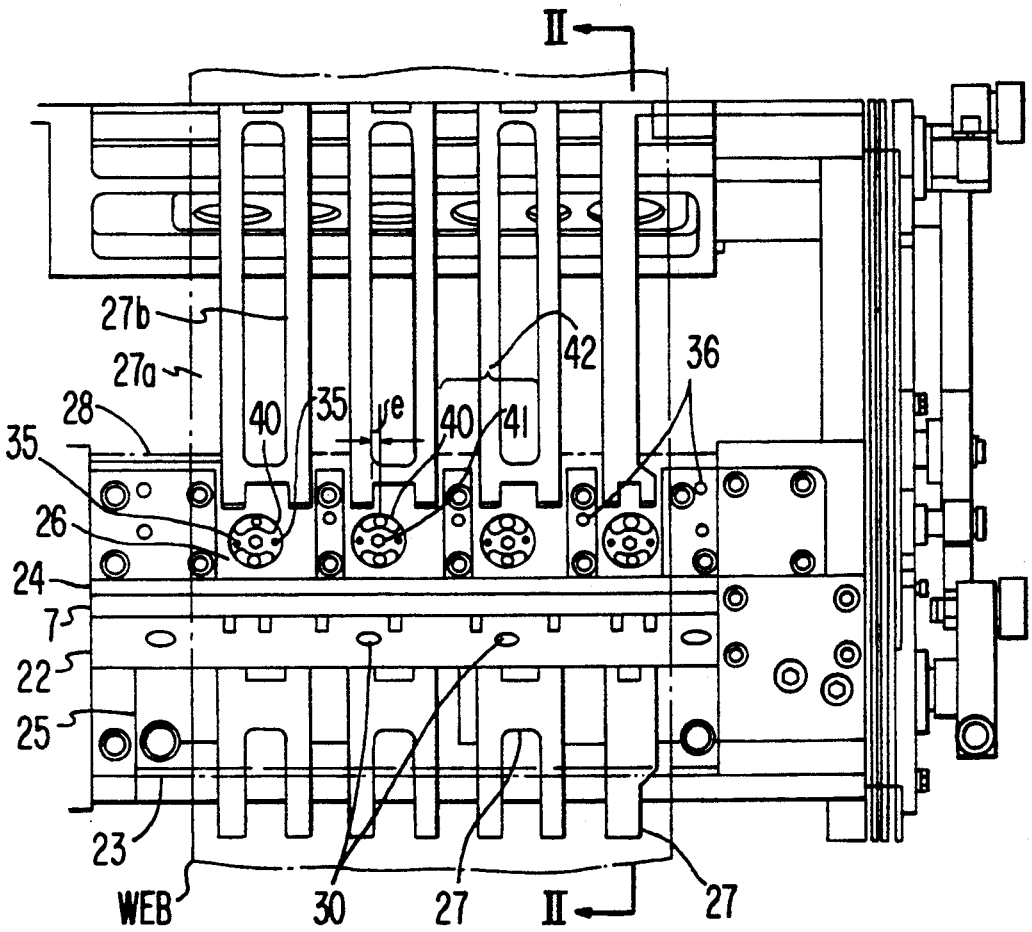
FIG. 1 is a plan view of one preferred embodiment of a folding drum in a folding machine for use with a rotary press according to the present invention.
Figure 2:
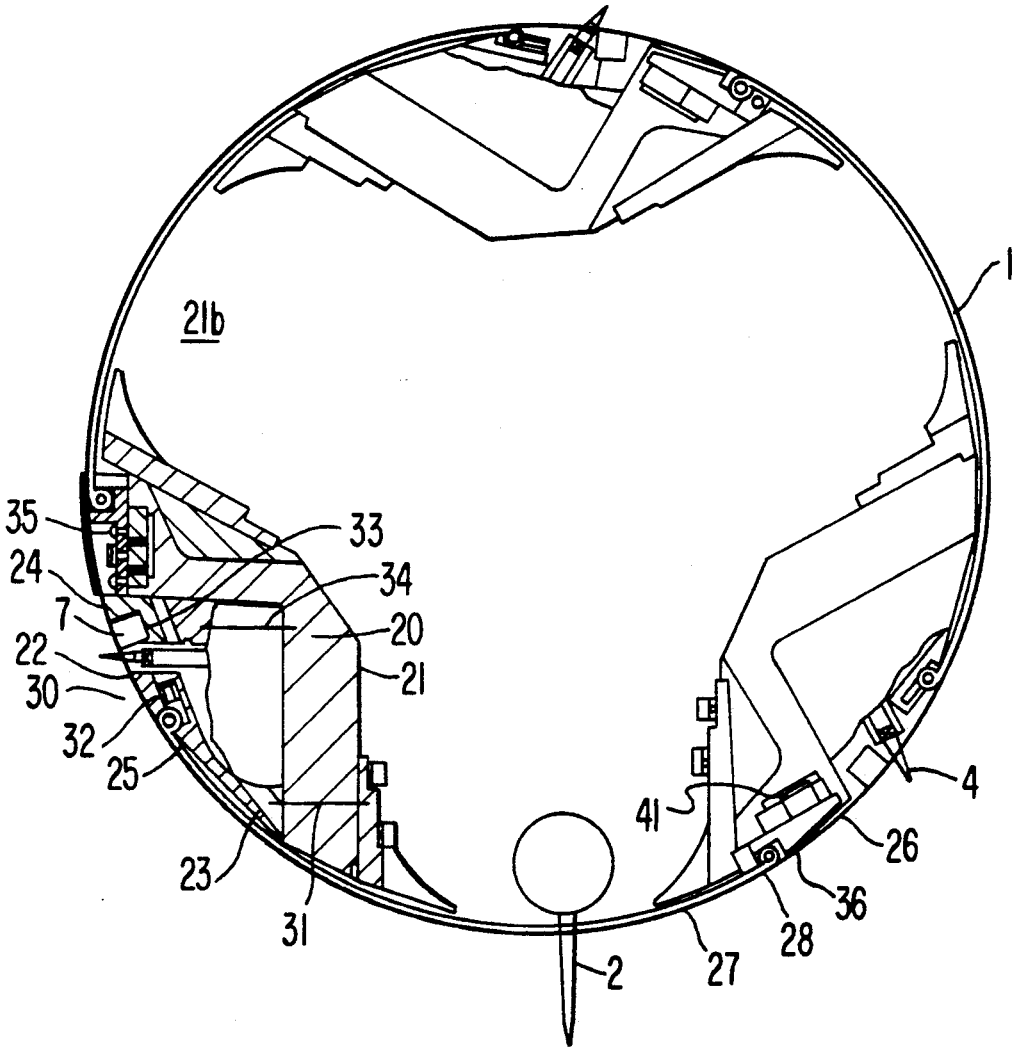
FIG. 2 is a vertical cross-sectional view of the same taken along line II—II in FIG. 1 as viewed in the direction of arrows.
Figure 3:
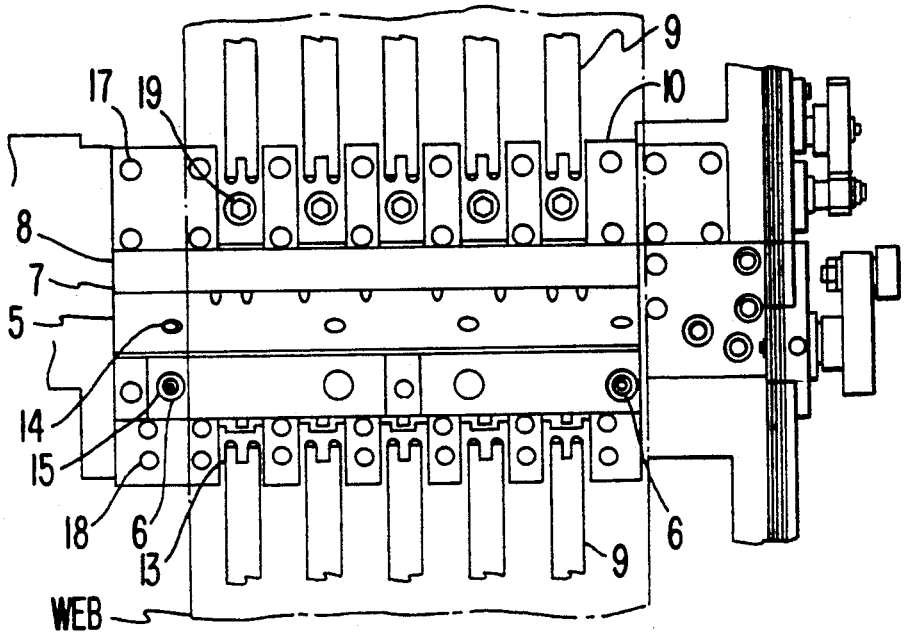
FIG. 3 (PRIOR ART)
FIG. 3 is a plan view of one example of a folding drum in a folding machine for use with a rotary press in the prior art, as viewed in the direction of arrows III—III in FIG. 4.
Figure 4:
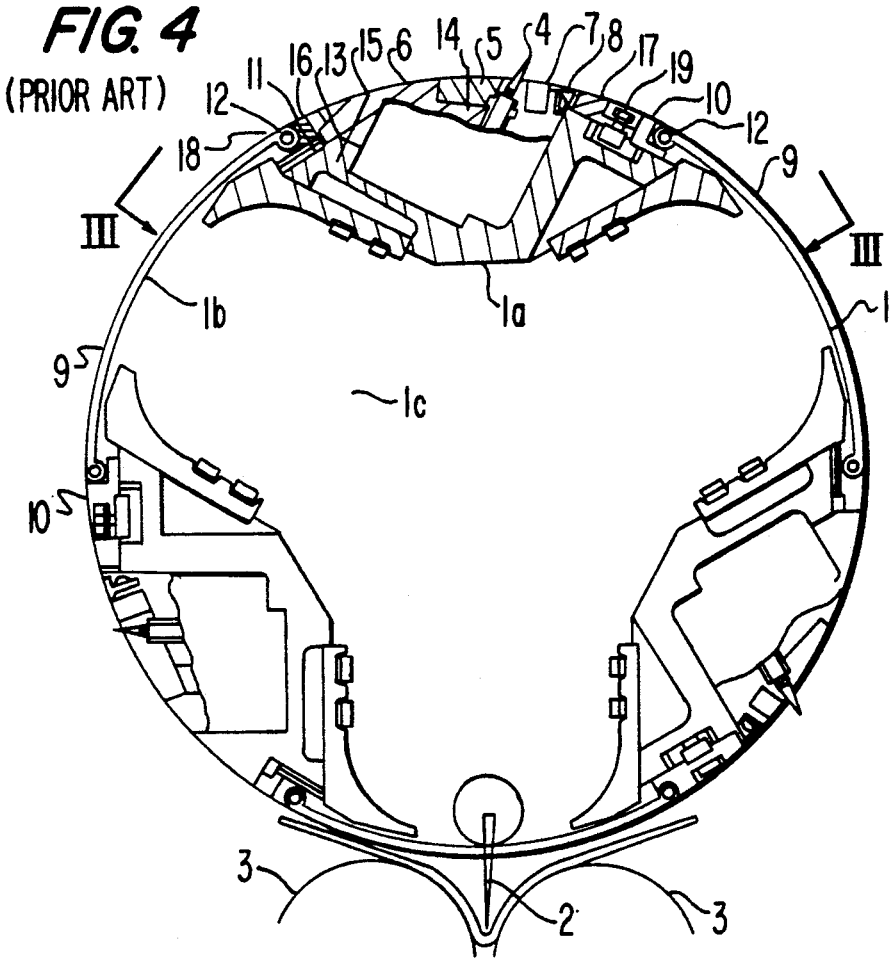
FIG. 4 (PRIOR ART)
FIG. 4 is a vertical cross-sectional view of the same.

Now the folding drum in a folding machine for use with a rotary press according to the present invention will be described in greater detail in connection with one preferred embodiment illustrated in FIGS. 1 and 2. In these figures, reference numeral 1 designates a generally cylindrical folding drum body, numeral 2 designates a folding blade, numeral 7 designates a needle receiving rack made of rubber, numeral 21*b* designates a vacancy, numerals 22, 23 and 28 designate covers, numeral 24 designates a holder, numeral 25 designates a fixed bracket, numeral 26 designates an adjusting rack having a circular hole therein, numeral 27 designates a plurality of aligned bands mounted to the adjusting rack 26, numerals 30, 35 and 36 designate bolts, numeral 40 designates an adjusting plate engaging the adjusting rack 26 within the circular hole, numeral 41 designates an adjusting shaft, and numeral 42 designates an adjusting device including the adjusting plate 40 and the adjusting shaft 41 as well as the adjusting rack 26. The above-mentioned plurality of (six in the illustrated embodiment) aligned bands 27 are divided into groups each consisting of at least two bands 27*a* and 27*b*. Band mount portions for each group are formed integrally with the bands. The band mount portions are mounted to the folding drum body 1 via adjusting devices 42, respectively associated with the respective groups, so as to be movable in the circumferential direction of the folding drum body 1. And adjustment is effected by the respective adjusting devices 42 so that the expansion of the bands 27 in the circumferential direction of the folding drum body 1 may be equalized. More particularly, the adjusting plate 40 is secured to the adjusting shaft 41 at an eccentric position deviated by a distance e from its center. The adjusting shaft 41 is mounted to the adjusting rack 26, and so, by rotating the adjusting plate 40, the adjusting rack 26 is moved and adjustment is effected in such manner that expansion of the respective bands 27 may be equalized. In the figures, reference numeral 28 designates covers for covering the respective adjusting devices 42.

Next, the operation of the folding drum in a folding machine for use with a rotary press shown in FIGS. 1 and 2 will be described in detail. When a multilayer cut web is folded up by projecting a folding blade 2 towards the web, a folded binder would tend to flutter due to airflows in the folding drum gap and in the gaps between the bands 27. Hence, problems such as end folding or the like would occur, and these problems would result in unacceptable folded binders. In addition, if the intervals between the tip end portions of the folding blades 2 projecting through the gaps between the bands 27 are too large, or a total width between the projecting portions of the folding blades 2 is narrow with respect to the width of the web, then unsatisfactory folding in which scratches or poor folding lines were produced would occur. When these problems are dealt with by narrowing the gaps between the bands 27, accompanied by a decrease in the width between projection portions of the folding blades 2, the total width of the projection portions is decreased, and so, the problem relating to quality cannot be resolved. However, in the folding drum according to the present invention, a plurality of aligned bands 27 are divided into groups each consisting of at least two bands 27*a* and 27*b*, band mount portions for each group are formed integrally with the bands, the band mount portions are mounted to the folding drum body 1 via adjusting devices 42 for the respective groups so that the bands in each group are movable in the circumferential direction, and adjustment is effected by the respective adjusting devices 42 so that expansion of the bands in the circumferential direction of the drum body 1 may be equalized. Consequently, the gaps between the respective bands 27 can be made narrow. Hence, upon folding the web, a waving of the web at the folding drum gap is eliminated, and it becomes possible to fold the web smoothly whereby folded binders of good quality are produced. This operation is especially effective in the case where the rotational speed of the folding drum is high. Accordingly, a high-speed printing operation becomes possible, and the overall printing time can be shortened.

As will be obvious from the detailed description of the preferred embodiment of the folding drum of the present invention above, owing to the fact that a plurality of aligned bands are divided into groups each consisting of at least two bands, band mount portions for each group are formed integrally with the band, the band mount portions are mounted to the folding drum via adjusting devices respectively associated with the respective groups so that the bands are movable in the circumferential direction of the drum body, and adjustment is effected by the respective adjusting devices so that expansion of the bands in the circumferential direction of the drum body may be equalized, the gaps between the respective bands can be made narrow. Hence upon folding the web, a waving or fluttering of the web at the folding drum gap is eliminated, it becomes possible to fold the web smoothly, and folded binders of good quality can be produced.

While a principle of the present invention has been described above in connection with one preferred embodiment of the invention, it is intended that all matter contained in the above description and illustrated in the accompanying drawings shall be interpreted to be illustrative and not as a limitation on the scope of the invention.

What is claimed is:

1. A folding drum of a folding machine for use with a rotary press, said folding drum comprising: a generally cylindrical drum body having an outer circumferential surface defining a gap therein; a plurality of bands extending parallel to one another in the circumferential direction of said drum body and disposed over the gap in the outer circumferential surface of said drum body; band mount portions integral with at least two of said bands, respectively, and connecting the at least two bands to one another such that a plurality of groups of at least two of said bands integrally connected to one another by said mount portions, respectively, are provided over the gap in the outer circumferential surface of said drum body; adjacent bands in each of said groups defining a respective gap therebetween, each said gap between adjacent bands having a width in the axial direction of said drum body and located over the gap in the outer circumferential surface of said drum body; a folding blade mounted to said drum body and having a plurality of blade tips each projectable to the outside of said drum body through a respective said gap between the adjacent bands in each of said groups thereof; and a plurality of adjusting device means each for securing a respective said group of bands to said drum body via the band mount portion integrally connecting the bands of said respective group and for adjusting the position of a said band mount portion in the circumferential direction of said drum body such that expansion of each of the bands of said respective group is adjustable in the circumferential direction of aid drum body to vary the width of each said gap between the adjacent bands in said respective group.

2. A folding drum as claimed in claim 1, wherein each of aid adjusting device means includes an adjusting rack mounted to said drum body so as to be movable in the circumferential direction thereof, an adjusting plate engaging said adjusting rack and an adjusting shaft connected to said adjusting plate and about which said adjusting plate is rotatable.

3. A folding drum as claimed in claim 2, wherein said adjusting rack has an opening therein defining an arcuate surface with which said adjusting plate is engaged, said adjusting plate is eccentrically mounted to said adjusting shaft with respect to the curvature of said arcuate surface, and said adjusting shaft is fixed to said adjusting rack.

* * * * *